US005280943A

United States Patent [19]

Commier et al.

[11] Patent Number: 5,280,943

[45] Date of Patent: Jan. 25, 1994

[54] SKI WITH A RIBBED UPPER SURFACE

[75] Inventors: Philippe Commier, Annecy; Jacques Le Masson, Cran-Gevrier, both of France

[73] Assignee: Salomon S.A., Annecy Cedex, France

[21] Appl. No.: 722,183

[22] Filed: Jun. 27, 1991

[30] Foreign Application Priority Data

Jul. 9, 1990 [FR] France ..... 90 08989
Mar. 27, 1991 [FR] France ..... 91 03980

[51] Int. Cl.[5] ..... A63C 5/00
[52] U.S. Cl. ..... 280/609
[58] Field of Search ..... 280/601, 607, 609, 610, 280/614, 615

[56] References Cited

U.S. PATENT DOCUMENTS 4,714,267 12/1987 Abondance et al. ..... 280/615
4,735,433 4/1988 Corbet et al. ..... 280/615
4,789,177 12/1988 Graillat ..... 280/615
4,838,572 6/1989 Diard et al. ..... 280/609
4,913,455 4/1990 Salsetti et al. ..... 280/615
4,971,349 11/1990 Diard et al. ..... 280/609

FOREIGN PATENT DOCUMENTS 435061 10/1926 Fed. Rep. of Germany .
2583296 12/1986 France .
8705525 9/1987 PCT Int'l Appl. .
622430 2/1978 Switzerland .

*Primary Examiner*—Richard M. Camby
*Attorney, Agent, or Firm*—Sandler Greenblum & Bernstein

[57] ABSTRACT

A ski for sliding on snow, having a lower sliding surface joined at two lateral surfaces along two lower edges, the lateral surfaces being joined at an upper surface. The ski is constructed such that the central zone of the upper surface of the ski, adapted to receive a binding that adapts to the boot of the user, includes a raised median rib, bordered by two lowered lateral portions; at least one of the front or rear zones of the upper surface of the ski includes a lower median portion, bordered by two raised lateral ribs.

40 Claims, 9 Drawing Sheets 192
12
L3
182
11
10
6
3
2
$e_a$
5
1
4
10
12
11
$e_b$ 71
7

$e_c$
71
7
92
91
82
81
H
9

8
$e_d$
5
4
71
L1
7

$e_e$
13
15
14

$e_f$
292
13
282
15
14

$e_g$

192
L3
132
11
12
10
6
3
2
ea
5
1
4
10
12
11
eb 7
71 ec
71
91
92
7
82
81
H
9 ed
8
5
4
71
L1
7 ee
15
13 ef
292
13
282
14
15
eg

SKI WITH A RIBBED UPPER SURFACE

BACKGROUND OF THE INVENTION

1. Field of the Invention

The present invention is related to skis used for winter sports, and adapted to slide on snow and ice.

2. Discussion of Background and Relevant Information

Conventional skis normally comprise a lower sliding surface that is attached to two lateral surfaces along two lower edges equipped with metallic running edges, the lateral surfaces being joined at an upper surface. The width of the skis is relatively small with respect to their length, their front end being curved upwardly to form a spatula. The thickness of the ski is generally more substantial in the central portion than in the front and rear portions of the ski. In the conventional shapes that are used most often, the width of the lower surface of the ski is smaller in the central portion than in the rear and front portions, the width being maximum in the front portion of the ski, that is, in the vicinity of the spatula.

In known ski structures, the upper surface of the ski is generally an adjusted surface, that is, defined by the longitudinal displacement of a straight transverse line parallel to the lower surface of the ski. In other words, the transverse section of the ski is generally a rectangle or a trapezoid, the longer opposite sides of the rectangle or the trapezoid being formed by the lower surface and the upper surface of the ski, the smaller opposite sides of the rectangle or the trapezoid being formed by the lateral surface of the ski.

The greater thickness in the central portion of the ski confers this central portion with increased rigidity. This central zone is also adapted to receive the bindings that adapt to the user's boot. Conversely, the front and rear zones of the ski, that have lesser thickness, are more flexible, and apt to be elastically deformed when the ski is used. Should one wish to manufacture skis with good flexibility in the rear and front zones, one would have to necessarily provide that such front and rear zones have less thickness.

A first problem that arises in traditional ski structures is that the central zone of the ski, that has relatively greater thickness in order to confer it with greater rigidity, brings about a fairly substantial distancing of the bindings with respect to the lower edges of the ski. The lower edges are those elements that are adapted to bite into the ice while making a turn. The efficiency of the lower edges equipped with running edges is all the better when the connection between the foot of the user and the running edge is more direct. The distancing between the running edge and the binding tends to deteriorate the efficiency of the running edges.

A second problem that arises in known ski structures is that the substantial reduction of the thickness of the front and rear zones of the ski tends to substantially reduce the mass of these front and rear zones, and thus substantially reduces the inertia of the ski, both around a central vertical axis, and around a central horizontal axis, that are perpendicular to the longitudinal direction of the ski. The moment of inertia around the vertical axis, or the rotational axis of the ski, influences the behavior of the ski in rotation, by determining the resistance that the ski generates to a variation in the direction of the movement. A ski with a relatively small moment of inertia, for example, a short ski that is light at its ends, is easier to turn than a ski with a relatively large moment of inertia. But this reduction of the movement of inertia decreases the stability of the ski. Conversely, a ski with a relatively large moment of inertia is especially stable directionally during quick descent, because the stresses exercised laterally on the ski by the inequalities of the slope are better absorbed due to the greater moment of inertia. On the other hand, the moment of inertia around its central horizontal axis, perpendicular to the longitudinal direction of the ski influences the vibratory behavior of the ski. It is known that vibrations can be harmful and lead to a loss of adherence to the ground by the lower edges of the ski, and consequently, to a directional instability.

SUMMARY OF THE INVENTION

The present invention thus aims to overcome these disadvantages, by means of a new shape for a ski. The shape of the ski evolves according to the considered longitudinal portion along the ski, and this evolving form is such that the rigidity of the central zone can be increased, and at the same time, the distance between the bindings and the running edges can be reduced; simultaneously, the evolving form is such that the front and/or rear zones of the ski can be provided with appropriate flexibility without unduly reducing the moment of inertia of the ski along a central vertical axis or along a central transverse axis of the ski.

The shape defined by the present invention enables the main mechanical characteristics of the ski to be substantially adapted in accordance with the desired behavior, and especially, the characteristics of inertia and of resistance to flexion.

The result is a substantial improvement in the behavior of the ski during turns, and an increase in the gripping length of the ski on the snow. The directional stability obtained is similar to that of long and heavy skis, without however, increasing the total weight of the ski, and by maintaining it at a value that is substantially less than that of heavy skis. It also appears that the fact that the bindings may be affixed onto the upper surface of the ski in the immediate vicinity of the lower edges of the ski substantially improves right angular stops and diminishes negative vibratory phenomena.

In order to achieve these goals, as well as others, the ski according to the present invention is such that:

the central zone of the upper surface of the ski, adapted to receive the bindings that adapt to the boot of the user, includes a raised median rib, bordered by two lowered lateral portions, in such a way, that the thicker median rib of the ski confers the appropriate mechanical rigidity to the central portion of the ski, whereas the thinner lateral portions of the ski constitute the preferred support zones for the binding nearest the lower edges of the ski, at least one of the front or rear zones of the upper surface of the ski comprises a lower median portion, bordered by two raised lateral ribs, in such a way that the thinner median portion confers the appropriate flexibility to the front and rear portions of the ski, whereas, the thicker lateral ribs of the ski constitute additional masses of inertia, improving the dynamic behavior of the ski.

Either of the front and rear zones of the ski may advantageously comprise a lower median portion bordered by the two raised lateral ribs.

BRIEF DESCRIPTION OF THE DRAWINGS

Other objects, characteristics and advantages of the present invention will become apparent from the description of the preferred embodiments that follow, in conjunction with the annexed drawings, in which:

FIG. 11 is a view similar to FIG. 2, whereas FIGS. 12-18 are views similar to FIGS. 3-9;

FIG. 22 is a transverse section of an embodiment;

FIG. 23 is a side elevational view, whereas FIG. 24 is a top plan view of another embodiment;

FIG. 25 is a transverse section along X—X of FIG. 23;

FIG. 26 is a view similar to FIG. 23 illustrating a variant;

FIG. 27 is a transverse section of a variant;

FIGS. 28 and 29 illustrate another embodiment;

FIG. 29 is transverse section along line Y—Y of FIG. 28;

FIGS. 30 and 31 are views that are similar to FIG. 28, illustrating two variants;

DETAILED DESCRIPTION OF THE PREFERRED EMBODIMENTS

Figure 1:
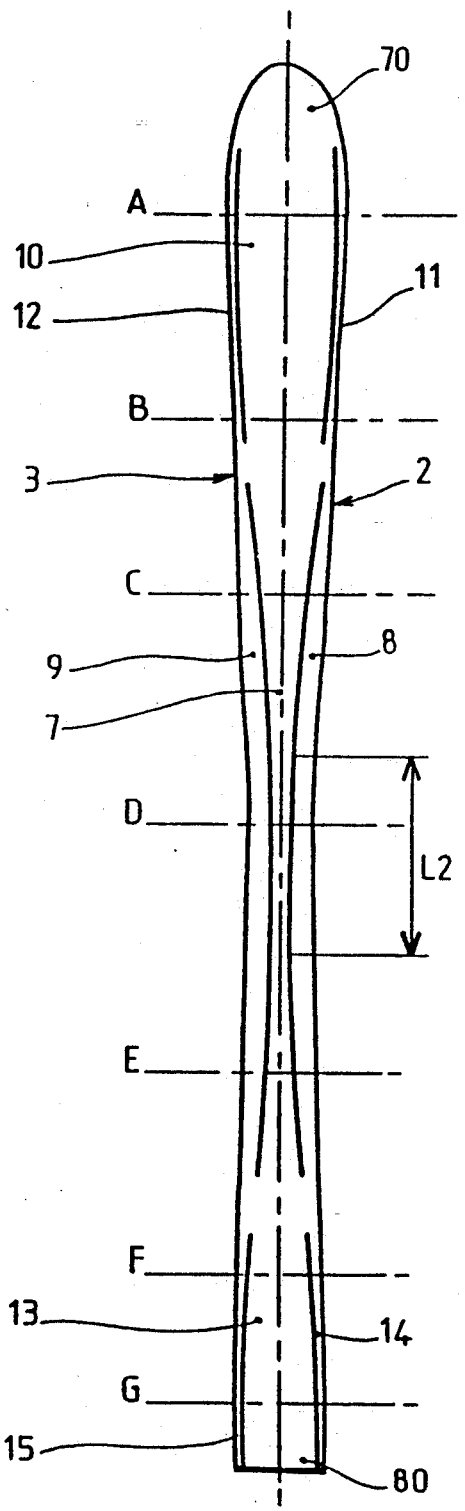
FIG. 1 is a schematic top plan view of the ski according to the present invention.

As is represented in the drawings, the ski comprises a lower sliding surface (1), that is joined at two lateral surfaces (2) and (3) along two respective lower edges (4) and (5) equipped with metallic running edges. The lower edges (4) and (5) defining the sides and the width of the ski. The lateral surfaces (2) and (3) are joined at the upper surface (6). The front end of the ski is curved upwardly to form a spatula (70). The rear end of the ski is curved slightly upwardly to form the heel (80). The ski can particularly comprise a spatula tip (70), and a heel protector (80), fixed by any means such as latching or gluing, for example.

The lateral surfaces (2) and (3) of the ski represented in the drawings are inclined with respect to the lower surface (1) of the ski, along an angle that is variable in accordance with the considered longitudinal position along the ski. In the embodiment represented, the lateral surfaces (2) and (3) are more vertical with respect to the sliding surface (1) in the central zone of the ski represented by sections C—C, D—D and E—E in FIGS. 5, 6 and 7, whereas in the end zones represented in FIGS. 3 and 9, the lateral surfaces (2) and (3) have a smaller angle of inclination with respect to the sliding surface (1).

Figure 2:
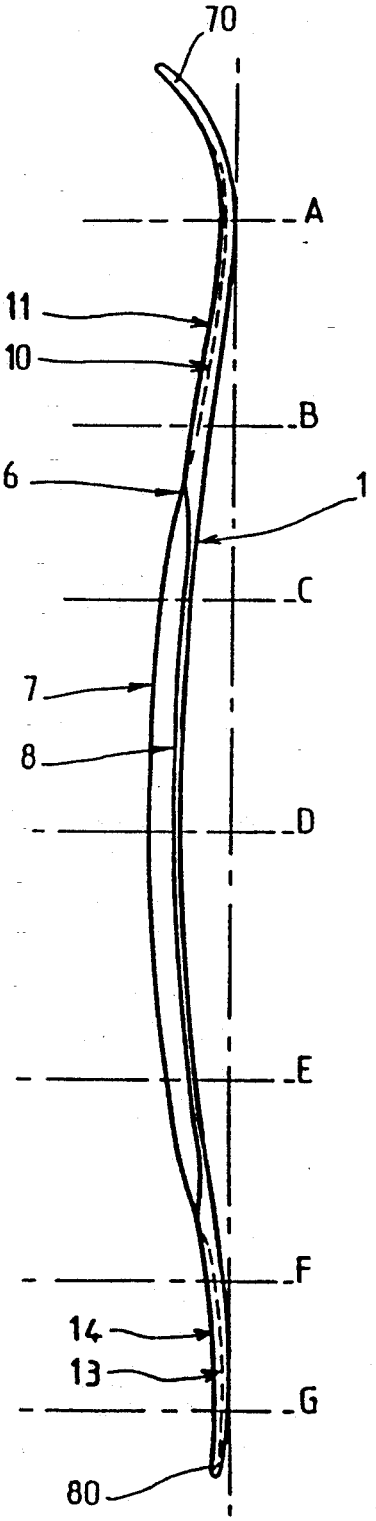
FIG. 2 is a side elevational view of the ski according to the present invention, the dimensions and deformations in the direction of the thickness of the ski having been deliberately represented at a greater scale than the length of the ski, in order to better understand the invention.
Figures 3, 4, 5, 6, 7, 8, 9:
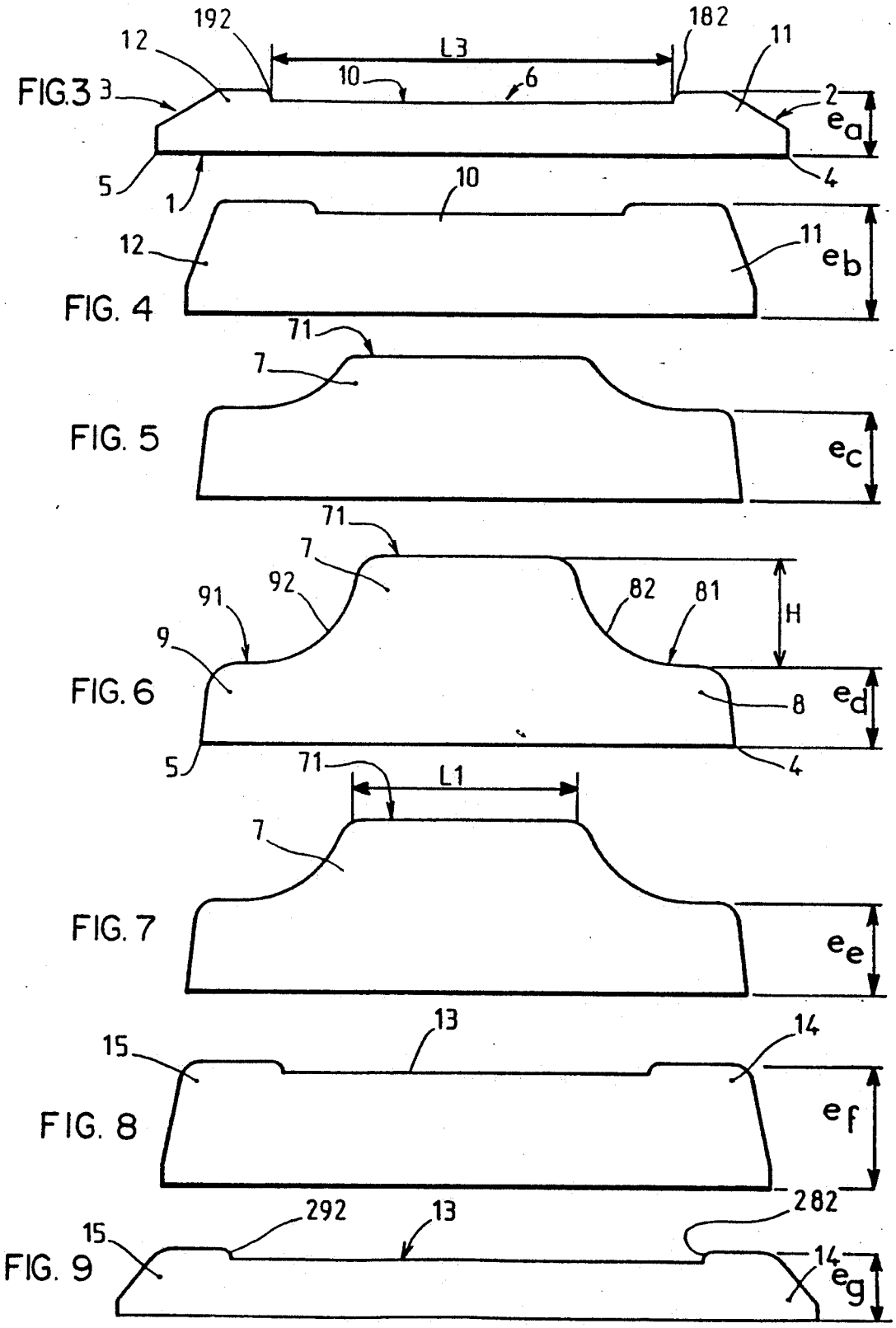
FIGS. 3-9 respectively represent the silhouette of the transverse sections of the ski according to the present invention, according to the sections A—A, B—B, C—C, D—D, E—E, F—F, G—G of FIGS. 1 and 2.

The central zone of the upper surface of the ski is considered to be constituted by that portion of the ski that is located between the third and two-third centered in the middle of the ski between the zones of section C—C and E—E represented in FIGS. 1 and 2. This central zone of the ski comprises an upper surface, adapted to receive bindings that adapt to the boot of the user. The upper surface comprises a raised median rib (7), bordered by two lower lateral portions (8) and (9). The median rib (7) constitutes a thicker portion of the ski, that is, that the distance between the upper surface of the median rib (7) and the lower surface (1) of the ski is accentuated, to confer the appropriate mechanical rigidity to the central zone of the ski. Conversely, the thinner lateral portions of the ski (8) and (9) constitute the preferred support zones for the binding, as close as possible to the lower edges (4) and (5) the ski. The median rib (7) comprises of an upper surface (71) that is substantially planar and that has a width L1 which is substantially constant along a length L2 of at least 50 centimeters on both sides of the average sectional plane D—D, that is, in the zone adapted to receive the bindings. In the same zone, the distance H separating the upper surface (71) of the rib (7) and the respective upper surfaces (81) and (91) of the lateral portions (8) and (9), is substantially constant, the upper surfaces (81) and (91) being themselves substantially planar. In this way, it is possible to adjust the longitudinal position of the binding adapted on the upper surface of the ski, in accordance with the size of the boot of the user. The upper surface (71) of the rib (7) is joined to the upper surfaces (81) and (91) of the lowered lateral portions (8) and (9) by the concave connecting portion (82) and (92), as is represented in FIGS. 5-7.

In the embodiment represented, the two lowered lateral portions (8) and (9) advantageously have the same thickness.

In the embodiment represented in the drawings, both the front and the rear zones of the ski include a lowered median portion bordered by two raised lateral ribs. Thus, the front zone of the ski, or the zone located between the spatula (70) and the plane of the tranverse section C—C, has an upper surface (6) whose median portion (10) is lowered, and is bordered by two raised lateral ribs (11) and (12). The result is that the median portion of the ski is less thick, and confers an appropriate flexibility to the front zone of the ski, whereas the thicker lateral ribs (11) and (12) of the ski constitute additional masses of inertia, that improve the dynamic behavior of the ski.

In the same way, the rear zone of the ski, comprised between the heel (80) and plane of the section E—E has a similar shape, including a thinner median portion (13) bordered by two lateral ribs (14) and (15).

As is represented in the side view of FIG. 2, the median rib (7) of the central zone is joined at the median portion (13) of the rear zone and at the median portion (10) of the front zone of the ski by a progressive joining slope. At the same time, the lateral portions (8) and (9) of the central zone are joined to the corresponding lateral ribs (11, 12, 14 and 15) by a progressive joining slope.

The lateral ribs (11, 12, 14 and 15) each comprise a substantially planar upper surface, and the lateral ribs substantially have the same thickness.

The median portion (10) of the front zone and the median portion (13) of the rear zone of the ski are both substantially planar, or are at least adjusted surfaces defined by the transverse generatrices parallel to the lower surface of the ski. They are joined at the corresponding lateral ribs by the convex portion (respectively 182, 192 and 282, 292) as is represented in the figures.

In the central zone of the ski, the median rib (7) has a width (L1) comprising between a quarter and three-quarters of the total width of the central zone of the ski. A non-limiting example of is a ski whose central zone, has a width of approximately 64 millimeters and includes a median rib (7) whose width comprises between 16 millimeters and 48 millimeters.

The lowered median portion (10) of the front zone of the ski has a width (L3) comprised between a half and three-quarters of the width of the ski in the said zone. It is the same for the lowered median portion (13) of the rear zone of the ski.

The special shape of the upper surface of the ski, in the central zone adapted to receive the binding, also has other advantages. In particular, the lateral recesses formed by the space located above the lateral portions (8) and (9) constitute two housings that can receive a portion of the operating mechanism of the bindings and/or the brakes of the ski. By the presence of the central rib (7), at a level higher than the lateral portions (8) and (9) the upper surface of the ski is increased, and thus constitutes an increased adhesive surface for the eventual adhesion of the bindings, by gluing, for example. The presence of the rib (7) also constitutes a guiding means for the positioning and the affixing of a binding on the upper surface of the ski.

According to the previous embodiment, the thickness "e" corresponding to the height of the lateral surfaces (2, 3) of the lateral edge of the ski is subject to a variation, such as the thickness "$e_d$" being less than the thickness "$e_c$" and "$e_e$", and, at the same time, "$e_c$" being less than "$e_b$" and "$e_e$" being less than "$e_f$". Moreover, the thickness "$e_b$" is greater than the thickness "$e_a$" and "$e_f$" is greater than "$e_g$".

Figure 10:
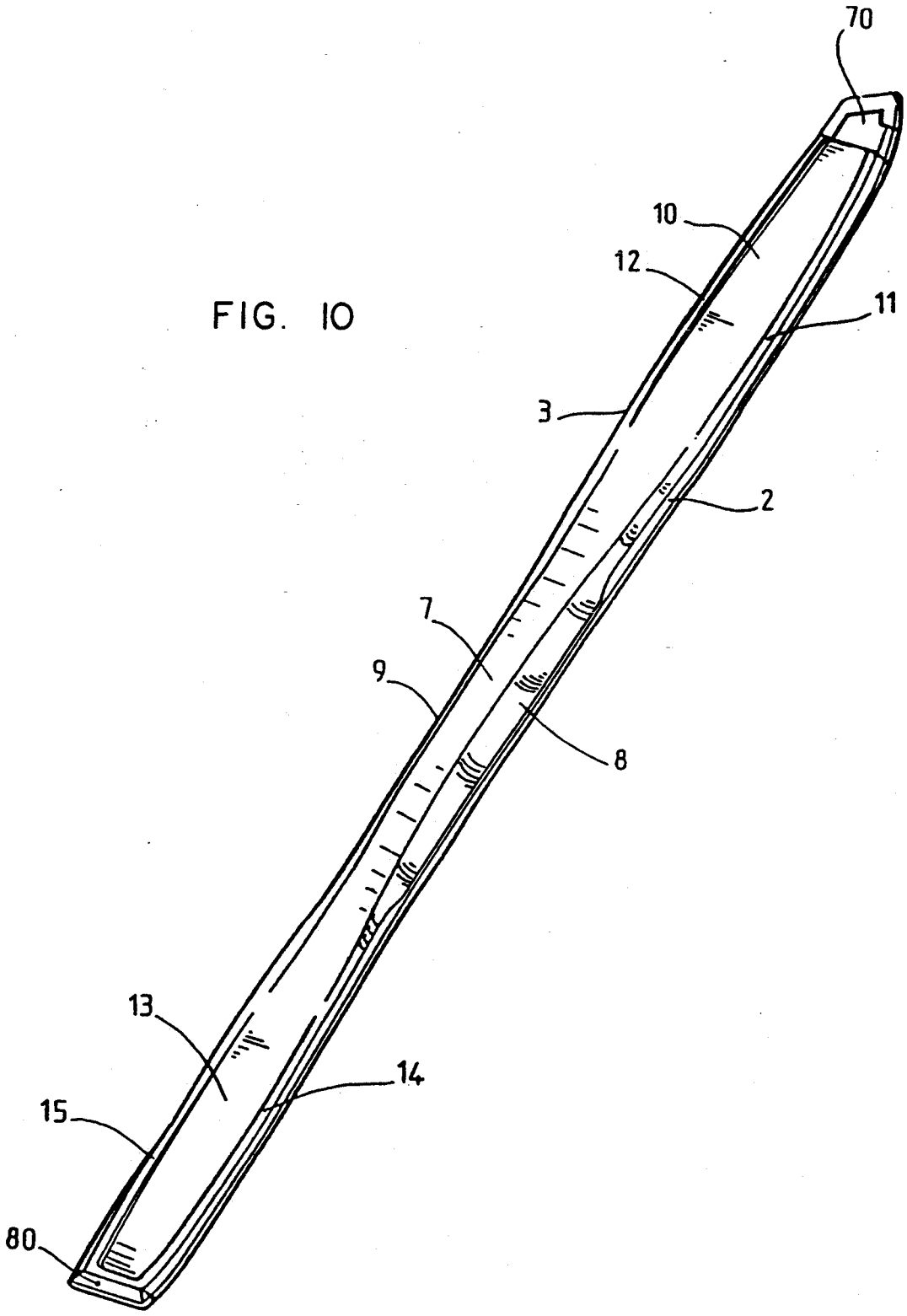
FIG. 10 is a perspective view illustrating the general shape of the ski according to the present invention.
Figure 11:
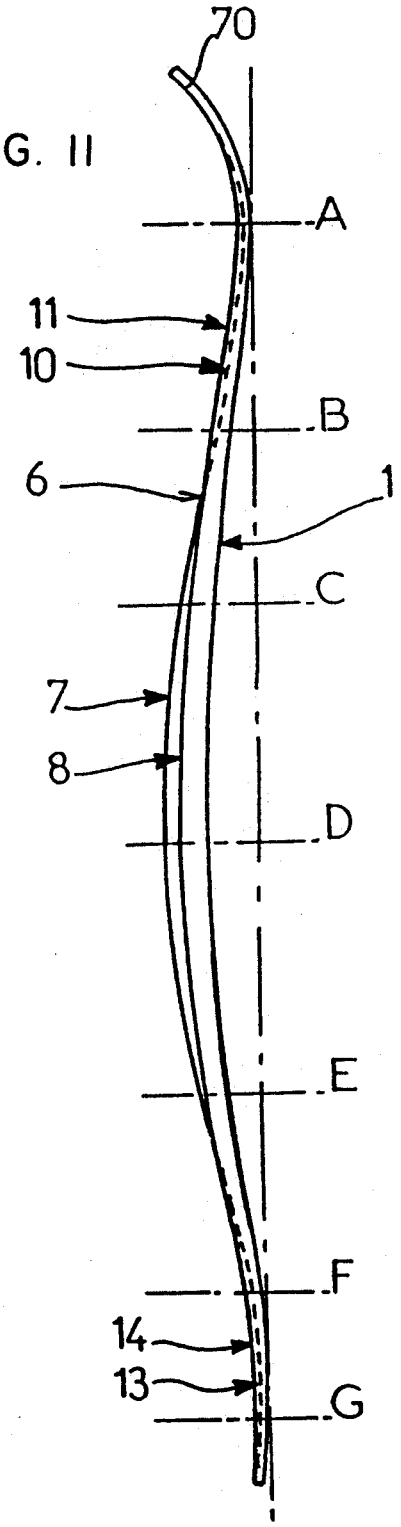
FIGS. 11-18 represent a variant of the embodiment.

Thus, and as is especially shown in FIGS. 2 and 10, the lateral portions (8) and (9) constitute the hollow zones with respect to the corresponding lateral ribs (11, 12 and 14, 15). But this arrangement and the variation of the thickness of the lateral edges of the ski may be entirely different, especially as has been represented in FIG. 11–18.

According to this embodiment, the lateral portions (8) and (9) do not constitute the hollow zones with respect to the corresponding lateral ribs. To this end, the thickness of the lateral edges decreases progressively towards the front and towards the rear. Thus, "$e_d$" is greater than "$e_c$";
"$e_c$" is greater than "$e_b$";
"$e_b$" is greater than "$e_a$";
"$e_d$" is greater than "$e_e$";
"$e_e$" is greater than "$e_f$"; and
"$e_f$" is greater than "$e_g$".

This variation in the thickness is given as a non-limiting example, and of course the thickness "e" can be arranged so as to be constant on at least one portion of the length of the ski, as for example, in the central zone.

Figures 12, 13, 14, 15, 16, 17, 18:
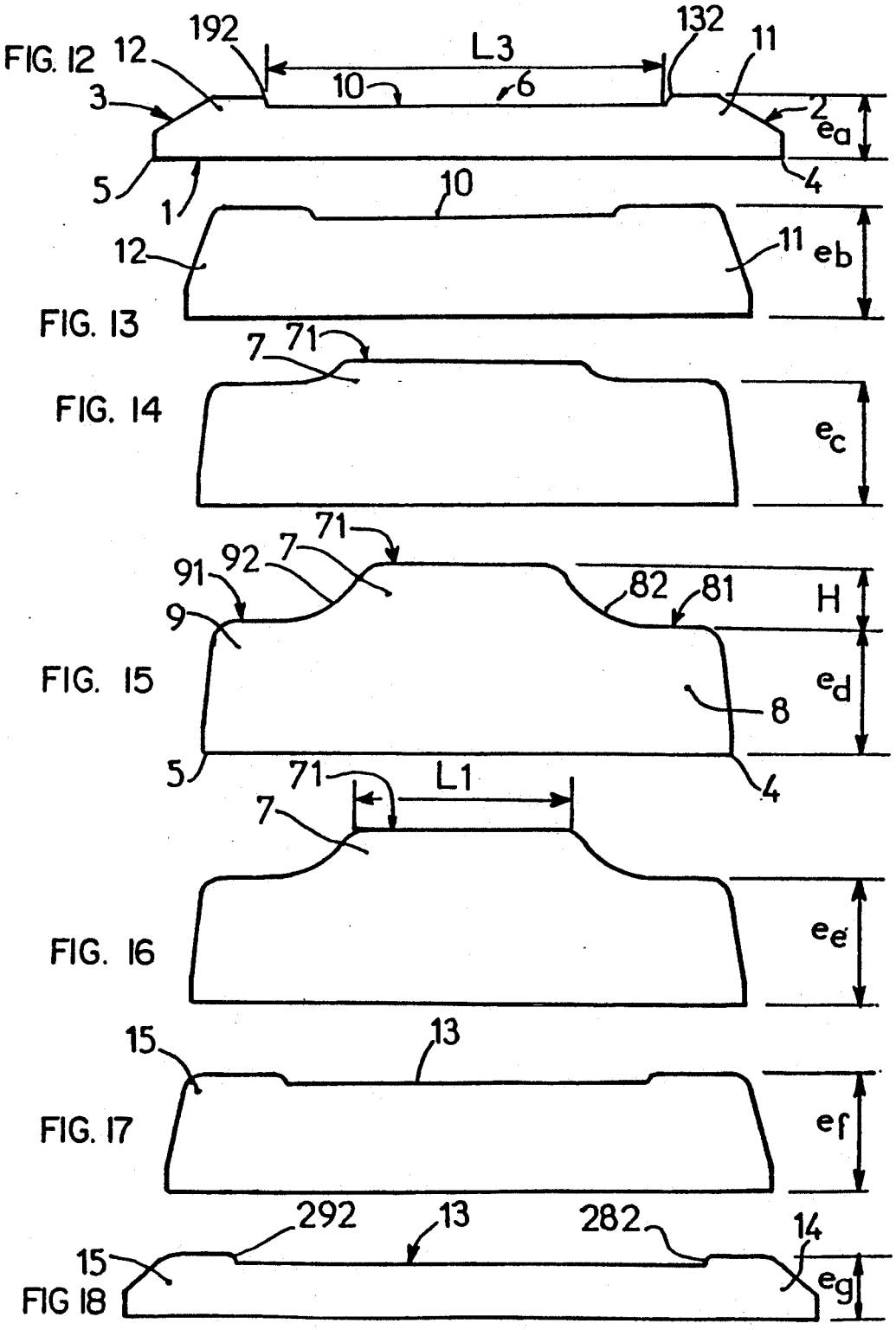
Figure 19:
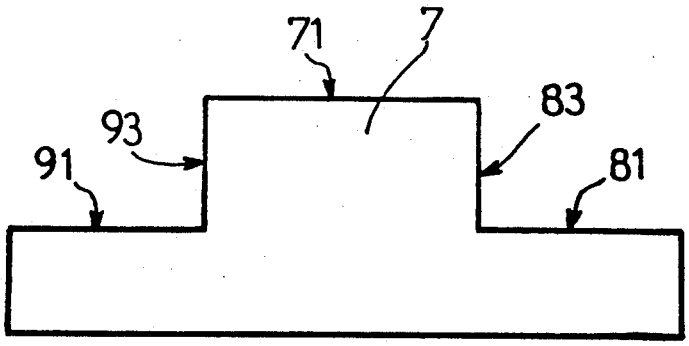
FIGS. 19 and 20 are views that are similar to FIGS. 6 and 15, illustrating two variants.
Figure 20:
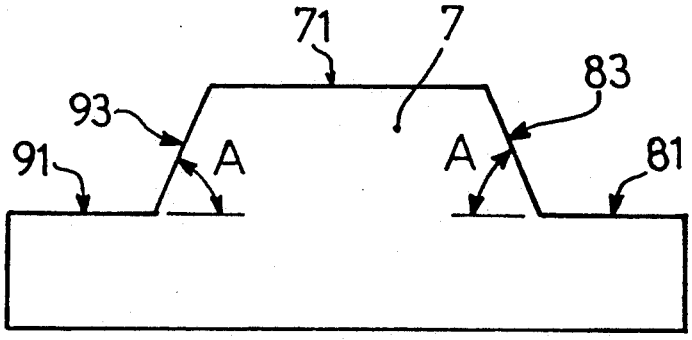

FIGS. 19 and 20 are similar views to FIGS. 6 and 15, and represent two variations of the embodiment of the ski according to the invention. According to these variations, the upper surface (71) of rib (7) is joined at the upper surfaces (81) and (91) of the lowered portions (8) and (9) by the lateral surfaces (83) and (93). According to the first of these embodiments, represented in FIG. 19, the lateral surfaces (83) and (93) are vertical or substantially vertical, whereas according to a second embodiment represented in FIG. 20, these are inclined so as to converge upwardly. It is also to be noted that the inclination of the two surfaces may be identical or different, and that the angle of inclination A may be variable along the length of the ski.

Figure 21:
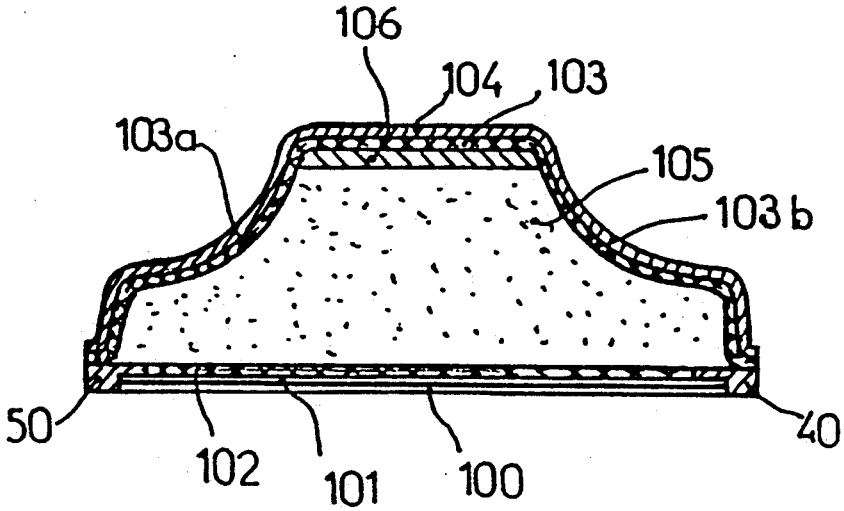
FIG. 21 is a view similar to FIG. 6, illustrating the details of the embodiments, and especially the constitution of the ski.

The structure of the ski may be of the sandwich or the box type, or of any other type. In FIG. 21, a preferred embodiment is represented, including an upper reinforcement (103) which is rigid and in the shape of a shell covering a core (105), the assembly being closed at its lower portion by a lower element including metallic running edges (50), (40), a sliding layer (100), generally made of polyethylene, as well as lower reinforcement elements (101, 102). An upper superficial layer (104) covers the upper reinforcement to form the decor of the ski.

The reinforcement layers (101, 102, 103) may be of any type, such as layers of composite materials like fiberglass, carbon fiber with epoxy resin or polyester, or of any metallic alloy.

The core (105) may be of charged foam, or non-charged foam, or wood, or of an aluminum honey comb shape.

The upper layer ensuring the decor may be of polyamide or other, such as a thermoplastic material. It may be constituted by a single layer, or several layers. Possibly, an insert (106) may be added, that may be of a composite or metallic material.

The reinforcement layers (103), and especially its lateral walls (103*a*) and (103*b*) are made of a composite material, whose reinforcements are advantageously made of weft fabric, whose weft is placed beside the core (105). This type of arrangement enables the girder that is thus constituted to have better resistance and better mechanical retention to the flexion and to the torque.

The boot of the skier is retained, in a known manner, to the ski by the bindings (17), generally releasable, enabling the release of the skier during very intense stresses. These bindings are affixed to the ski and the ski generally comprises a front binding (170) or an abutment retaining the front of the boot, and a rear binding (171), or a heel attachment retaining the heel of the boot.

Figure 22:
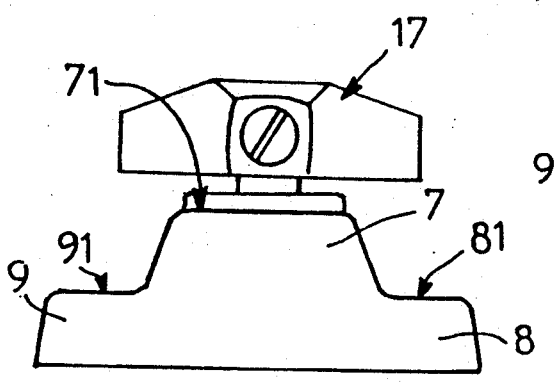

These bindings may be fixed directly on the upper surface (71) of rib (7) as is represented in FIG. 22. However, it will be particularly advantageous to arrange the supports on the upper surfaces (81) and (91) of the lateral portions (8) and (9), as is represented in FIGS. 23–29.

Thus, according to an additional characteristic of the invention, the ski comprises at least one support (16) adapted to receive the binding or bindings (17) for retention of the boot of the skier. The support (16) has the shape of a stirrup (FIG. 25) having the shape of an inverted "U", and comprising an upper wall (160), extended laterally and towards the base by two lateral walls (161) and (162) in order to constitute a lower housing (18) having the shape of a hollow profile extending longitudinally, adapted for passage of the rib (7). It must be noted that both the horizontal "L4" as well as the vertical "H4" dimensions of the housing are advantageously greater than the horizontal dimensions "L1" and vertical dimensions "H" of the rib. According to a characteristic of this embodiment of the invention, the rib (7) does not directly receive stresses from the skier, because the support or stirrup (16) is supported only on the upper surfaces (81) and (91) of the lateral portions (8) and (9).

To this end, the lower ends of the lateral walls (161) and (162) of the support are connected to the upper surfaces, for example, in a rigid fashion, by gluing, by welding, or by any other means, that could be mechanical.

The support (16) thus constitutes the mechanical transmission and distribution elements of the stresses of the skier on the ski.

Figure 23:
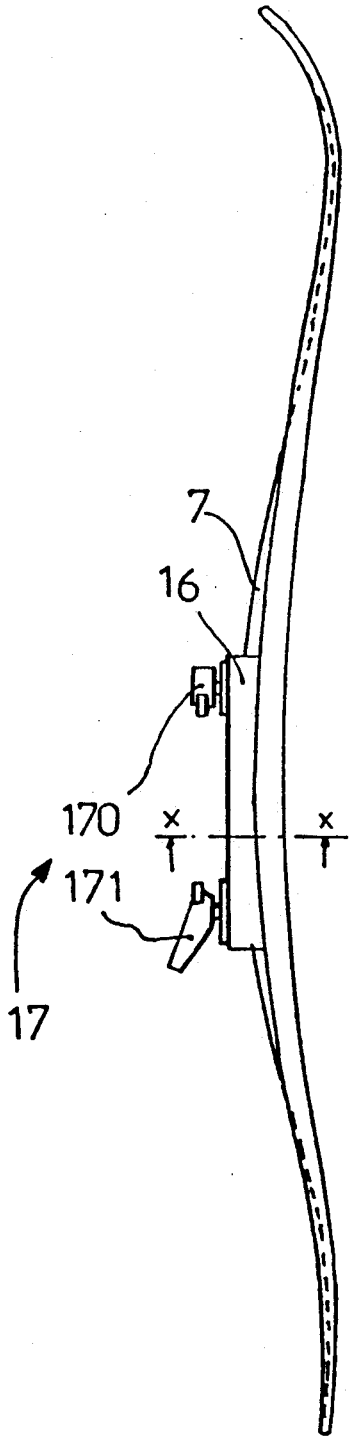
Figure 24:
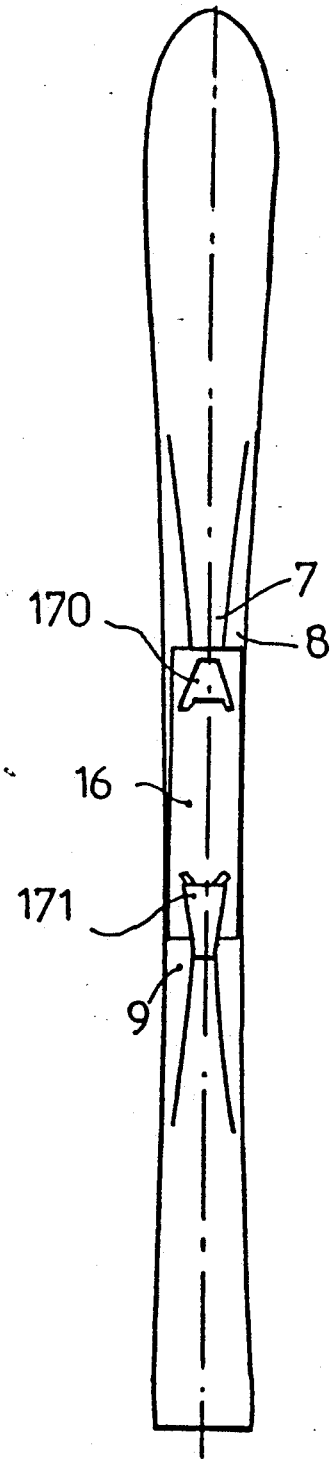

According to the embodiment of FIGS. 23 and 24 the support (16) is adapted to receive a front binding (170) at the front, and extends towards the rear under the rear binding (171); the rear binding (171), commonly referred to as the heel attachment, is itself affixed onto the rear portion of the support (16).

Figure 26:
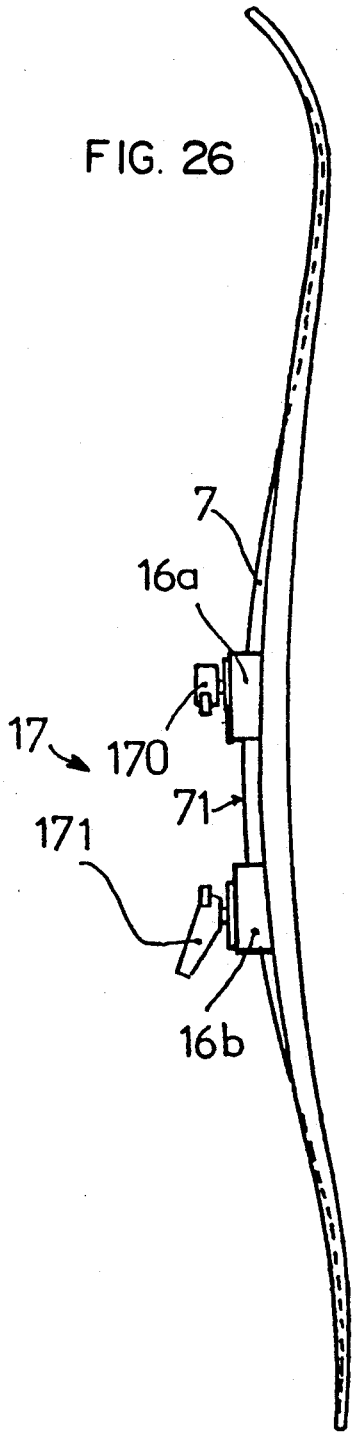
FIGS. 22-31 represent different embodiments of the binding retention.

FIG. 26 represents a variation according to ski comprises two supports (16), spaced from one another, a first front support (16*a*), on which a front abutment (170) for retention of the boot is fixed, and a second support on a rear support (16*b*) on which the heel attachment (171) is fixed.

The support (16, 16*a*, 16*b*) may be an injected element of a plastic material or a metallic profile, a plastic extruded or protruded element. Of course, the support (16, 16*a*, 16*b*) may be of a monobloc piece, or may be constituted of different pieces, even constituted of a portion of the corresponding binding.

Figure 28:
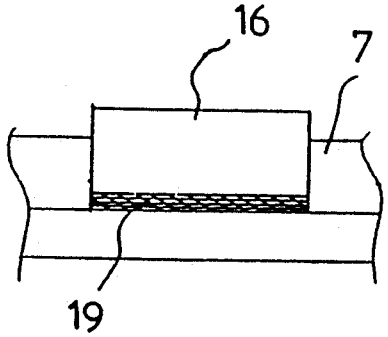
Figure 25:
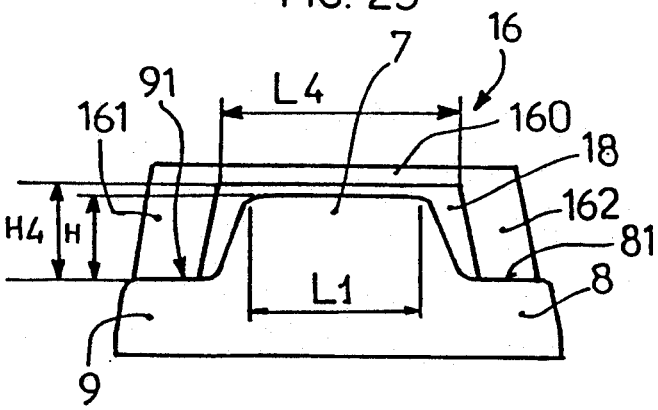
Figure 29:
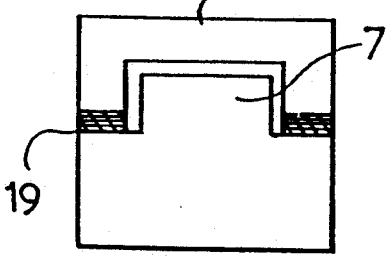

It must also be noted that the connection between the support (16, 16*a*, 16*b*) and the ski itself, may be rigid as is described previously, but also flexible. FIGS. 28 and 29 represent such a variation, in which the connection is achieved by an interface (19) of a flexible material.

Figure 27:
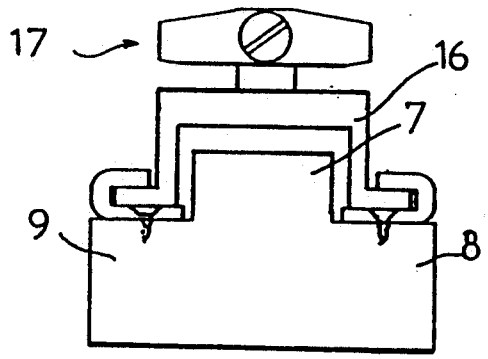

The connection may also be of a slide type, as is represented in FIG. 27, so as to enable the possible longitudinal sliding of the support (16) with respect to the ski. This longitudinal sliding enabling, for example, the adjustment and latching of the binding in the chosen position, or even sliding against the action of the spring, as is usual and well known in heel attachments adapted for retention of the heel of the boot.

Figure 30:
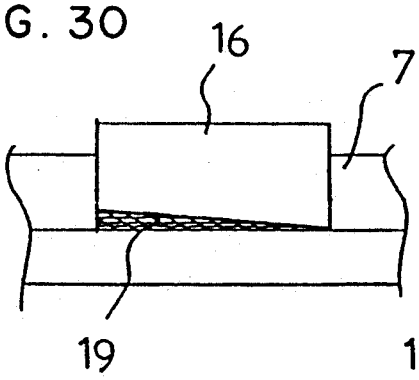
Figure 31:
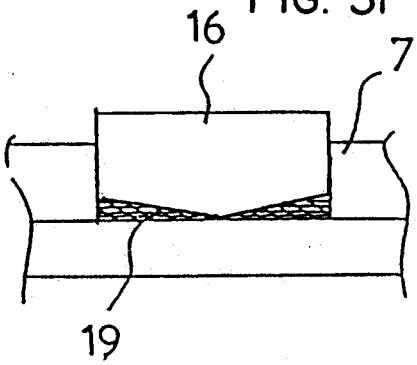

FIGS. 30 and 31 show variations according to which the flexible interface (19) connecting the support to the ski has a thickness which is not constant. In a variation in Figure (30), the thickness increases towards the front, but it may also increase towards the rear. In a variation represented in FIG. 31, the interface increases in thickness both towards the front and at the rear.

Figure 32:
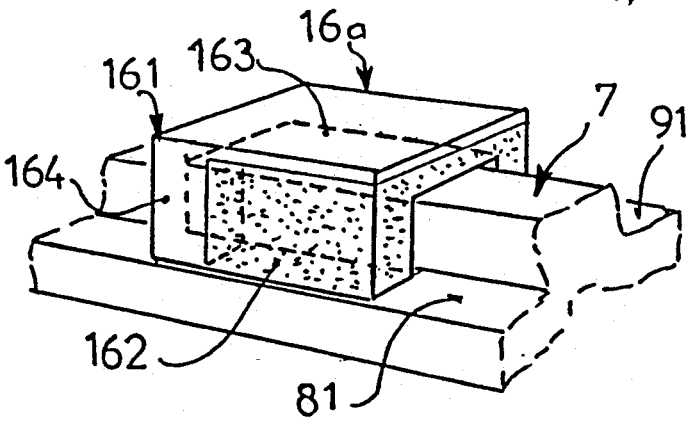
FIG. 32 is a perspective view illustrating a variant of the embodiment of the support.

FIG. 32 shows a variation of the support (16*a*). According to this variation, the support comprises two different materials: a first portion (161), made of a material (M1), for example, rigid, and a second portion (162), of another material (M2), for example, of a more flexible material. The rigid portion (161) comprises a horizontal portion (163) and of two lateral portions (164), the flexible portion (162) being arranged under the horizontal portion, and being located beside the center of the ski.

Figure 33:
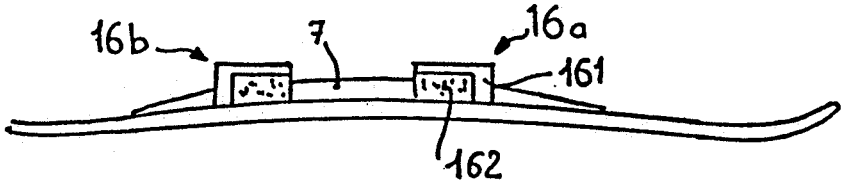
FIG. 33 is a lateral view of a ski equipped with the support represented in FIG. 32.

FIG. 33 shows a ski equipped with the support (16*a*) of FIG. 32. At the rear, the support (16*b*) is identical with the flexible portion turned towards the side of the center of the ski.

The instant disclosure is based upon French patent application Nos. 90 08989 and 91 03980, filed on Jul. 9, 1990 and Mar. 27, 1991, respectively, the priorities of which are hereby claimed, and the disclosures of which are hereby expressly incorporated by reference thereto in their entireties.

The present invention is not limited to the embodiments that have been explicitly described, and also includes other variations and generalizations contained in the field of the claims that follow.

What is claimed is:

1. A ski for moving on snow, comprising:

a lower sliding surface, being joined at two lateral surfaces along two lower edges, the lateral surfaces being joined at an upper surface;

the upper surface of the ski having a central zone, adapted to receive the bindings that adapt to a boot of the user, comprising a raised median rib, bordered by two lowered lateral portions, the ski having a predetermined width in the central zone and the raised median rib having a width comprising between a quarter and three-quarters of the predetermined width of the ski in the central zone; and at least one of the front and rear zones of the upper surface of the ski including a lowered median portion, bordered by two raised lateral ribs, said lowered median portion and raised lateral ribs being defined by a thickness that varies transversely of the ski.

2. Ski according to claim 1, wherein both the front and rear zones of the ski comprise a lowered median portion, bordered by two raised lateral ribs.

3. Ski according to claim 1, wherein the median rib of the central zone is joined at the lower median portion of the front or rear zones by a joining slope, the lateral portions of the central zone being attached to the corresponding lateral ribs, by the joining slopes.

4. Ski according to claim 1, wherein the height of the lateral surfaces is constant at least in a central zone of the ski.

5. Ski according to claim 4, wherein the height of the lateral surfaces is variable along at least a predetermined length of the ski.

6. Ski according to claim 5, wherein the height of the lateral surfaces decreases progressively from the central zone of the ski towards the front and rear zones.

7. Ski according to claim 6, wherein the height of the lateral surfaces at an area of the median rib is greater than the height of the lateral surfaces at the front and rear zones.

8. Ski according to claim 5, wherein the height of the lateral surfaces at an area of the median rib is less than the height of the lateral surfaces at the front and rear zones.

9. Ski according to claim 4, wherein the median rib is joined at corresponding lateral portions by connecting portions.

10. A ski for moving on snow, comprising:

a lower sliding surface, being joined at two lateral surfaces along two lower edges, the lateral surfaces being joined at an upper surface;

the upper surface of the ski having a central zone, adapted to receive the bindings that adapt to a boot of the user, comprising a raised median rib, bordered by two lowered lateral portions, the ski having a predetermined width in the central zone and the raised median rib having a width comprising between a quarter and three-quarters of the predetermined width of the ski in the central zone; and at least one of the front and rear zones of the upper surface of the ski including a lowered median portion, bordered by two raised lateral ribs, said lowered median portion and raised lateral ribs being defined by a thickness that varies transversely of the ski, wherein:

the height of the lateral surfaces is constant at least in the central zone of the ski;

the median rib is joined at corresponding lateral portions by connecting portions; and the connecting portions are concave.

11. Ski according to claim 4, wherein the median rib is joined at the upper surfaces of the lowered lateral portions by substantially vertical lateral surfaces.

12. Ski according to claim 4, wherein the median rib is joined at the upper surfaces of the lowered lateral portions by inclined lateral surfaces, converging upwardly.

13. Ski according to claim 1, wherein the lateral ribs are joined to the median portion by connecting portions.

14. A ski for moving on snow, comprising:

a lower sliding surface, being joined at two lateral surfaces along two lower edges, the lateral surfaces being joined at an upper surface;

the upper surface of the ski having a central zone, adapted to receive the bindings that adapt to a boot of the user, comprising a raised median rib, bordered by two lowered lateral portions, the ski having a predetermined width in the central zone and the raised median rib having a width comprising between a quarter and three-quarters of the predetermined width of the ski in the central zone; and at least one of the front and rear zones of the upper surface of the ski including a lowered median portion, bordered by two raised lateral ribs, said lowered median portion and raised lateral ribs being defined by a thickness that varies transversely of the ski, wherein:

the lateral ribs are joined to the median portion by connecting portions; and the connecting portions are convex.

15. Ski according to claim 1, wherein the median rib comprises a substantially planar upper surface.

16. Ski according to claim 15, wherein the lower lateral portions comprise a substantially planar upper surface, the two lateral portions having substantially the same thickness.

17. Ski according to claim 16, wherein, along a length of at least 50 centimeters, in the zone adapted to receive the bindings, a distance separating the upper surface of the median rib and the upper surface of the lateral portions is substantially constant in order to enable the adjustment of the longitudinal position of the bindings.

18. Ski according to claim 1, wherein the lateral ribs each comprise a substantially planar upper surface, the two lateral ribs having, in the corresponding zones, substantially the same thickness.

19. Ski according to claim 18, wherein the lowered median portion comprises a substantially planar upper surface.

20. Ski according to claim 1, wherein the median rib of the central zone has a width that is comprised between a half and a quarter of the total width of the central zone.

21. Ski according to claim 1, wherein the lowered median portion of at least one of the front zone and rear zone of the ski has a width comprised between a half and three-quarters of the width of the ski in said zone.

22. Ski according to claim 1, further comprising, at least in the central zone, a core, covered by an upper reinforcing layer, said reinforcing layer comprising a glass fiber of the weft type.

23. Ski according to claim 1, further comprising at least one support that is in lateral support on the upper surfaces of the lateral portions and is adapted to receive the bindings for the maintenance of the foot.

24. Ski according to claim 23, wherein the support has the shape of a stirrup having the shape of an inverted "U", and comprises an upper wall, extending laterally and towards the base by two lateral walls, to constitute a lower housing having the shape of a hollowed profile extending longitudinally, adapted for the passage of the rib.

25. Ski according to claim 24, wherein both the horizontal as well as the vertical dimensions of the lower housing are greater than the horizontal dimensions and the vertical dimensions of the rib.

26. Ski according to claim 25, further comprising a front binding on a front portion of the support and a rear binding on a rear portion of the support.

27. Ski according to claim 23, wherein said at least one support comprises two supports, spaced from one another, comprising a first support onto which a front abutment is fixed for retention of the boot, and a second support on which a heel attachment is fixed.

28. Ski according to claim 23, wherein the at least one support is made of a monobloc piece.

29. Ski according to claim 27, wherein each of the supports is constituted by a portion of a corresponding binding.

30. Ski according to claim 23, wherein the connection between the support and the ski is rigid.

31. Ski according to claim 23, wherein the connection between the support and the ski is flexible, and achieved by an interface made of a flexible material.

32. Ski according to claim 23, wherein the at least one support is constituted by different elements.

33. A ski comprising:

a lower sliding surface;

an upper surface;

lateral surfaces joined to the lower sliding surface at lateral edges and to the upper surface, said lateral surfaces comprising, on either of two opposed lateral sides of the ski, a surface extending upwardly from a respective one of said lateral edges to a surface inclined relative to said lower sliding surface;

the upper surface of the ski comprising:

(i) a central zone for receiving bindings for mounting a boot of a skier onto the ski, said central zone comprising, in transverse cross-section, a median portion bordered by two lateral portions, said median portion having a height extending between the lower sliding surface and the upper surface at the median portion that is greater than a height of either of said two lateral portions, the height of each of said two lateral portions extending between the lower sliding surface and the upper surface at each of said two lateral portions;

(ii) a front zone extending forwardly of said central zone; and (iii) a rear zone extending rearwardly of said central zone;

at least one of the front and rear zones of the upper surface of the ski comprising, in transverse cross-section, a median portion, bordered by two lateral portions, said median portion of said at least one of the front and rear zones having a height extending between the lower sliding surface and the upper surface at the median portion that is less than a height of either of said two lateral portions of said at least one of the front and rear zones, the height of each of said two lateral portions of said at least one of the front and rear zones extending between the lower sliding surface and the upper surface at each of said two lateral portions of said at least one of the front and rear zones.

34. The ski according to claim 33, wherein both of the front and rear zones of the upper surface of the ski comprising, in transverse cross-section, a median portion, bordered by two lateral portions, said median portion of each of the front and rear zones having a height extending between the lower sliding surface and the upper surface at the median portion that is less than a height of either of said two lateral portions of each of said of the front and rear zones, the height of said two lateral portions of each of the front and rear zones extending between the lower sliding surface and the upper surface at each of said two lateral portions of the front and rear zones.

35. A ski comprising:

a lower sliding surface;

a front end and a rear end;

a pair of opposite lateral sides;

an upper surface extending laterally between said pair of sides and extending longitudinally between said front end and said rear end, said upper surface having a width defined by said pair of sides;

said ski comprising a central zone, a forward zone and a rearward zone, a longitudinally extending median portion and longitudinally extending lateral portions at least in respective portions of each of said central zone, said forward zone and said rearward zone, each of said longitudinally extending median portion and longitudinally extending lateral portions comprising respective portions of said upper surface of the ski, each respective portion being defined by a discontinuity in said upper surface of said ski;

in said central zone, said median portion having a thickness, defined by said lower sliding surface and said upper surface, greater than respective thicknesses of either of said lateral portions; and in at least one of said forward zone and said rearward zone, said median portion having a thickness, defined by said lower sliding surface and said upper surface, less than respective thicknesses of either of said lateral portions.

36. A ski according to claim 35, wherein in both of said forward zone and said rearward zone, said median portion has a thickness, defined by said lower sliding surface and said upper surface, less than respective thicknesses of either of said lateral portions.

37. Ski according to claim 1, wherein each of the lateral surfaces extend upwardly from a respective lower edge along a generally vertical surface, each said generally vertical surface extending upwardly to a respective one of said two lateral surfaces, each of said two lateral surfaces being inclined relative to said lower sliding surface.

38. Ski according to claim 1, wherein each of said raised lateral ribs comprises an upper surface that is independent of and distinct from an upper surface of the other of said raised lateral ribs.

39. Ski according to claim 38, wherein each said upper surface of said raised lateral ribs is generally horizontal.

40. A ski comprising:

a lower sliding surface, being joined at two lateral surfaces along two lower edges, the lateral surfaces being joined at an upper surface;

the upper surface of the ski having a central zone, adapted to receive the bindings that adapt to a boot of the user, comprising a raised median rib, bordered by two lowered lateral portions; and at least one of the front and rear zones of the upper surface of the ski including a lowered median portion, bordered by two raised lateral ribs, said lowered median portion and raised lateral ribs being defined by a thickness that varies transversely of the ski, wherein:

said raised median rib has a predetermined width at a predetermined position in said central zone and said lowered median portion has a predetermined width at a predetermined position in at least one of the front and rear zones of the upper surface of the ski; and said predetermined width of said lowered median portion is less than said predetermined width of said raised median rib.

* * * * *